US009719461B2

(12) United States Patent
Maki et al.

(10) Patent No.: US 9,719,461 B2
(45) Date of Patent: Aug. 1, 2017

(54) BULKHEAD INSERT FOR AN INTERNAL COMBUSTION ENGINE

(71) Applicant: Ford Global Technologies, LLC, Dearborn, MI (US)

(72) Inventors: Clifford E. Maki, New Hudson, MI (US); Jeffrey Eliot Chottiner, Farmington Hills, MI (US); Rick L. Williams, Canton, MI (US); Mark W. Thibault, Canton, MI (US); James Douglas Ervin, Novi, MI (US); James Maurice Boileau, Novi, MI (US); Bryan McKeough, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 288 days.

(21) Appl. No.: 14/620,809

(22) Filed: Feb. 12, 2015

(65) Prior Publication Data

US 2016/0237946 A1 Aug. 18, 2016

(51) Int. Cl.
*F02F 7/00* (2006.01)

(52) U.S. Cl.
CPC ..... *F02F 7/0021* (2013.01); *F02F 7/0007* (2013.01); *F02F 7/0012* (2013.01); *F02F 7/0053* (2013.01); *F02F 7/0085* (2013.01); *F02F 7/0095* (2013.01)

(58) Field of Classification Search
CPC ..... F02F 7/0021; F02F 7/0007; F02F 7/0065; F16M 1/025
See application file for complete search history.

(56) References Cited

U.S. PATENT DOCUMENTS 3,046,953 A 7/1962 Dolza
4,651,691 A 3/1987 Ogawa
4,848,292 A * 7/1989 Holtzberg ..... F02F 7/0085 123/193.3
5,816,710 A * 10/1998 Warwick ..... F02F 7/0053 384/433

(Continued)

OTHER PUBLICATIONS http://www.greencarcongress.com/2014/06/20140618-mmlv.html, "The technology behind Ford's Lightweight Concept Vehicle; prospects for Mach-II with 50% mass reduction difficult", Jun. 18, 2014, 9 pages.

(Continued)

*Primary Examiner* — Kevin R Lathers
(74) *Attorney, Agent, or Firm* — Brooks Kushman P.C.; Greg Brown

(57) ABSTRACT

An engine includes a cylinder block defining at least one main bearing bulkhead adjacent to a cylinder, and a crankshaft rotatably housed within the block by a main bearing. A bulkhead insert has a cap portion, and an insert portion provided within the bulkhead. The insert portion has having first and second end regions connected by first and second straps. Each strap having a flanged beam cross section. The first and second ends of the insert portion are configured to connect a main bearing cap column to a cylinder head column. Each of the first and second end regions define at least one protrusion having a surface substantially normal to engine combustion and reactive loads. The cap portion is configured to mate with the first end region at the main bearing cap column and support the main bearing.

20 Claims, 5 Drawing Sheets

(56) References Cited

U.S. PATENT DOCUMENTS

| | | | | |
|---|---|---|---|---|
| 6,283,081 | B1 * | 9/2001 | Ozeki | F02F 1/108 123/193.2 |
| 9,086,031 | B2 | 7/2015 | Williams et al. | |

OTHER PUBLICATIONS

Skszek et al., "Multi-Material Lightweight Vehicles: Mach-II Design", Jun. 17, 2014, 27 pages.
http://media.gm.com/Pages/news/us/en/2014/mar/ecotec/english/0319-ecotec-technologies.html, "New Ecotec Engines Deliver More with Less Complexity", Mar. 19, 2014, 7 pages.
U.S. Appl. No. 14/101,213, entitled "Engine Having Composite Cylinder Block", filed Dec. 9, 2013, 23 pages.

* cited by examiner

BULKHEAD INSERT FOR AN INTERNAL COMBUSTION ENGINE

STATEMENT REGARDING FEDERALLY SPONSORED RESEARCH OR DEVELOPMENT

The invention was made with Government support under Contract No. DE-EE0005574 awarded by the Department of Energy. The Government has certain rights to the invention.

TECHNICAL FIELD

Various embodiments relate to a bulkhead insert for an internal combustion engine.

BACKGROUND

An internal combustion engine has an engine block defining one or more cylinders. A cylinder head attaches to the block to form combustion chambers with the cylinders of the block. The block may form bulkheads between adjacent cylinders that provide structural support for the engine and separation between the cylinders. Typically, the engine block and the head are fastened or bolted together, for example, using head bolts that extend along and through head bolt columns. As the engine operates, the translational motion of the pistons within the cylinders is transformed into a rotational motion of a crankshaft. The crankshaft may be connected to the engine block and is supported for rotation by main crankshaft bearings. The crankshaft may be generally opposed to the engine head and may have a series of fasteners, such as main bearing bolts, that retain the crankshaft in the main bearings and adjacent to the block. As the engine operates, the head bolts and the main bearing bolts are loaded due to forces on the engine caused by combustion within the cylinders, and their corresponding reactive loads or forces. These forces may cause significant stress and fatigue on the engine and on the engine block.

SUMMARY

In an embodiment, an engine is provided with a cylinder block defining at least one main bearing bulkhead adjacent to a cylinder, and a crankshaft rotatably housed within the block by a main bearing. The engine has a bulkhead insert with an insert portion and a cap portion. The insert portion is provided within the bulkhead and having first and second end regions connected by first and second straps. Each strap has a flanged beam cross section. The first and second ends of the insert portion are configured to connect a main bearing cap column to a cylinder head column. Each of the first and second end regions define at least one protrusion having a surface substantially normal to engine combustion and reactive loads. The cap portion is configured to mate with the first end region at the main bearing cap column and support the main bearing.

In another embodiment, an engine main bearing structure is provided with a bulkhead insert for connecting a main bearing cap column to a head column. The insert has first and second ends connected by a pair of straps. Each strap has an I-beam cross-section. Each end defines at least one protrusion having a surface normal to engine combustion and reactive loads. The first end is shaped to support a crankshaft main bearing, and the second end is configured to receive head bolts.

In yet another embodiment, a method of forming an engine includes providing a bulkhead insert in a tool. The bulkhead insert is configured to connect a main bearing cap column to a cylinder head column and has first and second straps. Each strap has a flanged beam cross section. The insert defines protrusions having surfaces substantially normal to engine combustion and reactive loads. An engine block is formed having a bulkhead containing the bulkhead insert in the tool.

DETAILED DESCRIPTION

Figure 1:
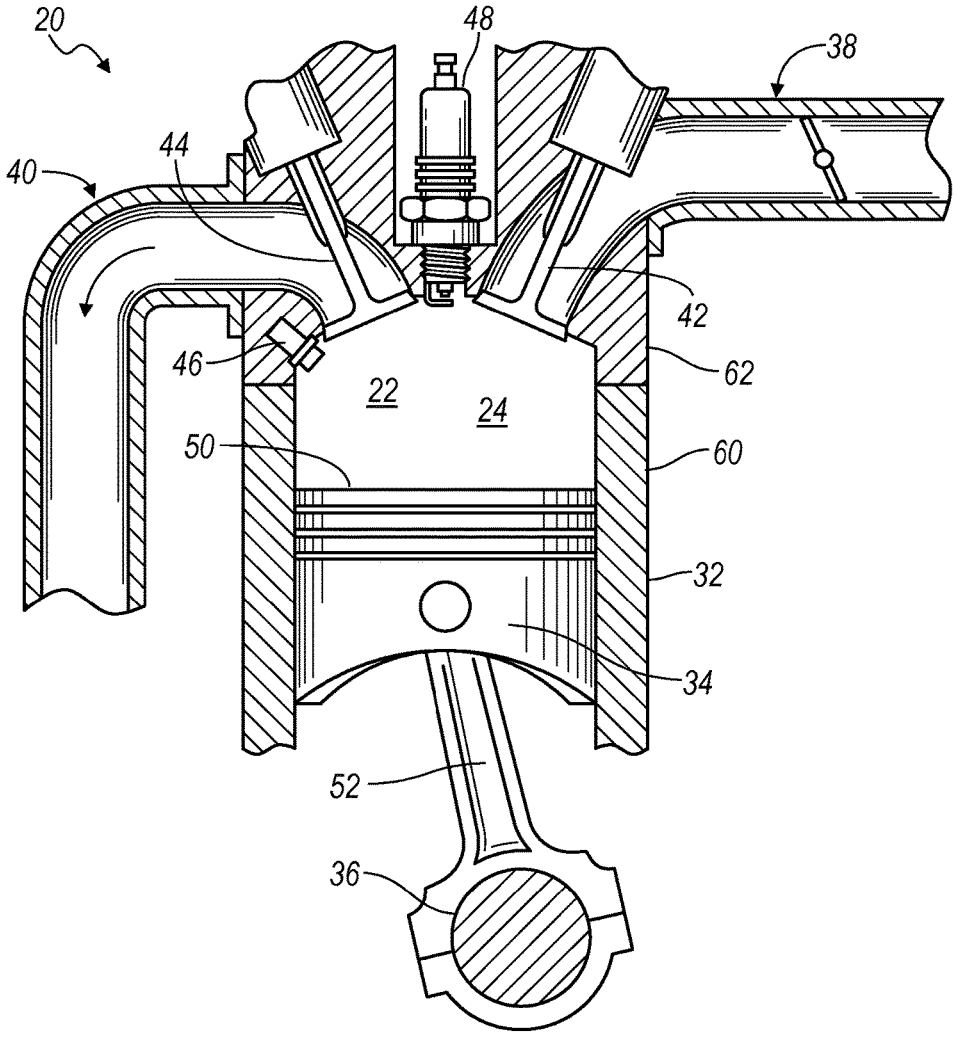
FIG. 1 illustrates a schematic of an engine configured to implement the disclosed embodiments.

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

In various examples, an internal combustion engine is provided with an insert positioned within a bulkhead region of a cylinder block. The bulkhead insert provides additional structural strength to the engine by directly connecting the head bolt column to the main bearing column, or the engine head bolts to the main bearing bolts. The bulkhead insert may be provided with members such as straps that extend between the head bolts and the main bearing bolts. The straps may have an I-beam cross-section, or another flanged, beam cross-section that provides an increased load carrying capability. The two straps of the insert may be connected to one another by an arch connection that provides a continuous connection between the straps for even load distribution. The arch connection may be without a corner or similar discontinuity that would otherwise provide additional stress points in the insert.

The structure of the insert provides for compact packaging for use in the engine block, while enabling higher loads to be carried through the insert compared to the bulkhead alone. As engine design moves towards smaller block sizes and more compact structures, the size of an insert also decreases and the corresponding packaging constraints on the bulkhead insert increases. As engine design moves towards weight reduction, the engine block may be made from alternative materials such as an aluminum alloy, a composite material, and the like. The bulkhead insert may be made from a different material from the block, e.g. an iron alloy, to provide the desired strength for the engine and act as the primary load carrying structure within the bulkhead and between the head bolts and main bearing bolts, while being sized for the limited packaging space.

The bulkhead insert may be provided with additional structural features that provide surfaces that are inclined relative to or generally normal to the combustion and reactive forces within the engine during operation to absorb these loads into the insert along the natural load path and dissipate the loads from concentrating in localized areas near the main bearing cap bolt column or boss and the head bolt column or boss. In one example, the bulkhead insert is provided as a near-net-shape, cast, ferrous insert that is positioned within an engine block die for an aluminum casting. The insert provides support for the crankshaft main bearing, and is fracture split to also provide the main bearing cap.

The insert provides a tie strap configuration to connect the head bolt columns to the main bearing cap columns. This insert then becomes a cast-in-place bulkhead insert of which the combustion loads are carried through the stronger insert material opposed to the bulkhead of the block. The insert provides increased load carrying capabilities. A conventional cylinder block bulkhead width is defined by peak combustion loads that the bulkhead and the crank main journal connection need to carry in addition to a safety factor for block durability and life. The engine block provides a packaging constraint with cylinder bore size and cylinder bore spacing. A cast-in-place bulkhead insert according to the present disclosure nests within the bulkhead width in the fore-aft direction known as the crank axis or longitudinal axis of the engine, and is partially encapsulated within the block bulkhead width starting from centerline of crank bore upwards to cover the entire head bolt column end and connecting strap of the insert. The insert also provides main bearing bolt columns that are integrated into the bulkhead insert. The size and shape of the connecting strap and insert provides an increased load carrying member for the bulkhead. The shape of the connecting strap of the insert may be further constrained based on packaging of the cylinder block lubrication circuit. Additionally, the insert provides the needed strength for smaller, compact engine block designs with narrower bulkheads.

FIG. 1 illustrates a schematic of an internal combustion engine 20. The engine 20 has a plurality of cylinders 22, and one cylinder is illustrated. The engine 20 may include multiple cylinders arranged in various manners, including an inline configuration and a V-configuration. The engine 20 has a combustion chamber 24 associated with each cylinder 22. The cylinder 22 is formed by cylinder walls 32 and piston assembly 34. The piston assembly 34 is connected to a crankshaft 36. The combustion chamber 24 is in fluid communication with the intake manifold 38 and the exhaust manifold 40. An intake valve 42 controls flow from the intake manifold 38 into the combustion chamber 30. An exhaust valve 44 controls flow from the combustion chamber 30 to the exhaust manifold 40. The intake and exhaust valves 42, 44 may be operated in various ways as is known in the art to control the engine operation.

A fuel injector 46 delivers fuel from a fuel system directly into the combustion chamber 30 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 30. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 operates under a four-stroke cycle including an intake stroke, a compression stroke, an ignition stroke, and an exhaust stroke. In other examples, the engine may operate using a two-stroke cycle. During the intake stroke, the intake valve 42 opens and the exhaust valve 44 closes while the piston assembly 34 moves from the top of the cylinder 22 to the bottom of the cylinder 22 to introduce air from the intake manifold to the combustion chamber. The piston assembly 34 position at the top of the cylinder 22 is generally known as top dead center (TDC). The piston assembly 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston assembly 34 causes a corresponding movement in crankshaft 36 and provides for a mechanical torque output from the engine 20. The combustion process causing the expansion stroke results in loads and forces on the engine 20. A force on the engine caused by the combustion event in the chamber 24 imparts a force on the face 50 of the piston 34, and at least a portion of the force travels down the connecting rod 52 to the main bearing and crankshaft 36. This force on the main bearing may be referred to as a reactive force. The combustion event within the chamber 24 also causes a force on the cylinder head 62, which loads attachment points, such as head bolts, between the engine head 62 and a cylinder block 60. The force on the cylinder head and head bolts may be referred to as a combustion force.

During the exhaust stroke, the intake valve 42 remains closed, and the exhaust valve 44 opens. The piston assembly 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 may have a cylinder block 60 that forms the cylinders 22. A cylinder head 62 is connected to the block 60. The head 62 encloses the combustion chamber 24 and also supports the various valves 42, 44, and intake and exhaust systems 38, 40. A head gasket or another sealing member may be positioned between the block 60 and the head 62 to seal the combustion chamber 24.

Figure 2:
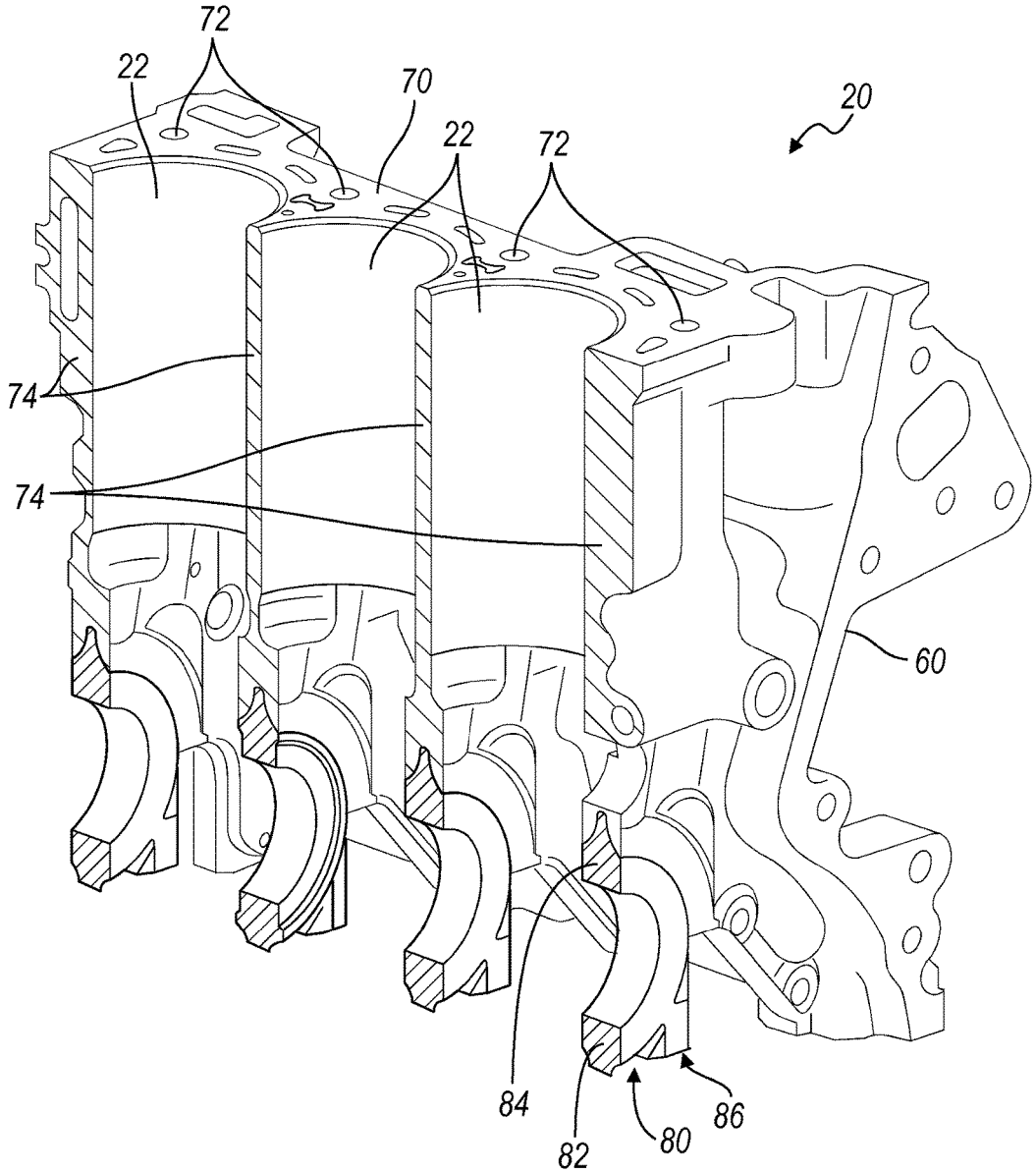
FIG. 2 illustrates a perspective sectional view of an engine block with an insert according to an embodiment.

FIG. 2 illustrates a portion of the engine 20 according to an example. The engine 20 is illustrated as an in-line, three cylinder engine, although other configurations are also contemplated. The engine 20 is shown as a sectional view with the section line taken in a plane through the rotational axis of the crankshaft.

The engine block 60 is shown with a deck face 70 that is configured to mate with a corresponding deck face of a cylinder head 62 or a head gasket. The block 60 has attachment features 72 to connect the cylinder head 62. In the example shown, the cylinder head 62 is connected to the block 60 using fasteners such as cylinder head bolts into threaded bores in head bolt columns 72.

A bulkhead 74 is formed by the block 60 between adjacent cylinders 22 and between a cylinder 22 and end of the block 60. The bulkhead 74 typically has a pair of cylinder head columns 72 associated with it, although only one is shown in the present Figure due to the view.

An insert 80 is provided in the bulkhead 74 of block 60. The insert 80 provides a support structure for a main bearing for a crankshaft 36. The insert 80 has a main bearing cap 82 (or cap portion) that attaches to a cap end region 84 of the insert 80 to encircle a main bearing and rotatably support the crankshaft 36. The pistons of the engine 20 may be connected to the crankshaft 36 between the main bearing caps 82.

The insert 80 has attachment features 86 to connect the main bearing cap 82 to the cap region 84. In the example shown, the main bearing cap 82 is connected to the remainder of the insert 80 using main bearing bolts into threaded bores in main bearing bolt columns 86. These main bearing bolt columns 86 may also be provided in or adjacent to the bulkhead 74 of the engine 20.

A crankcase (not shown) may be provided and is connected to the block 60 to generally enclose the crankshaft, contain lubricant, etc. The crankcase is generally opposed to the deck face 70 in the present example, as the crankshaft is generally opposed to the cylinder head.

Figure 3:
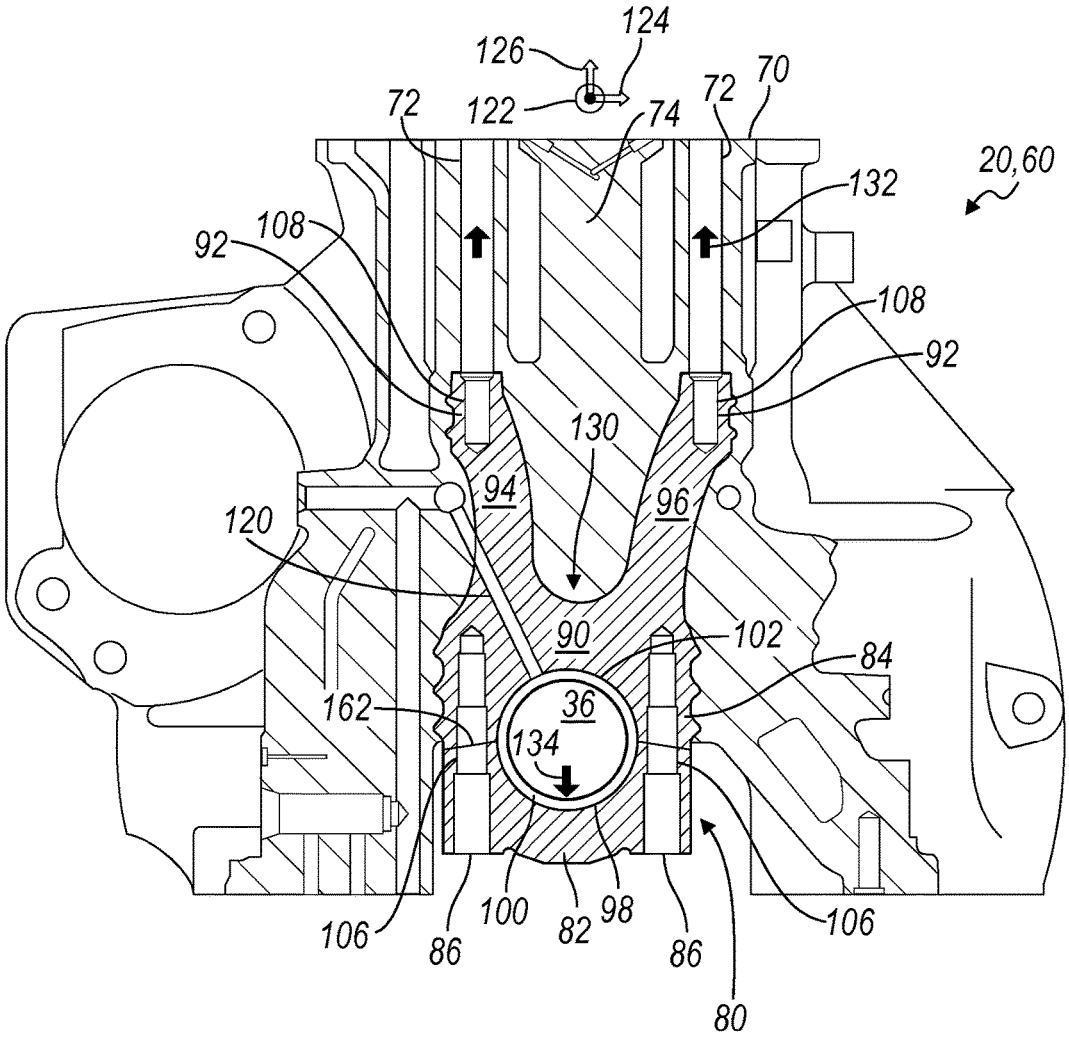
FIG. 3 illustrates another sectional view of the engine block and insert of FIG. 2.

FIG. 3 illustrates a cross sectional view of the engine 20 taken through the bulkhead 74. The block 60 is formed with a bulkhead insert 80 within the bulkhead 74. The insert 80 may be formed as a single integral component and then divided or split after the block 60 is cast or formed, or before the block 60 is formed. The insert 80 has an insert portion 90 and a cap portion 82. The insert portion 90 is generally provided within the bulkhead 74 and has a first end region 84 (or cap end region) and a second end region 92. The first and second end regions 84, 92 are connected by first and second straps 94, 96.

The insert 80 has a main bearing cap 82 or cap portion 82. The cap portion 82 has a surface 98 that is shaped to support at least a portion of a main bearing 100 for a crankshaft 36. The end region 84 of the insert portion 90 also has a surface 102 that is shaped to support another portion of the main bearing 100 for the crankshaft 36. The surfaces 98, 102 encircle the main bearing 100. The cap 82 connects and mates with the end region along part line 162.

The first and second end regions 84, 92 of the insert 80 are configured to provide a connection between the main bearing cap columns 86 and the cylinder head columns 72.

The cap portion 82 and the end region 84 of the insert portion 90 define an attachment feature 106 for each main bearing cap column 86. In the present example, the attachment feature 106 is a bore, such as a tapped bore, that is sized to receive a main bearing bolt or other fastener to connect the cap portion 82 to the insert portion 90. All or a portion of the bore may be tapped. Tapped regions of the bore may be located in both portions 82, 90, or only in one portion 90. Therefore, the main bearing bolts connect only to the insert 80 and any loads are transferred directly through the insert. Loads on the remainder of the block 60 may therefore be indirect.

The end regions 92 of the insert portion 90 define an attachment feature 108 for each cylinder head column 72. In the present example, the attachment feature 108 is a bore, such as a tapped bore, that is sized to receive a head bolt or other fastener to connect the cylinder head 62 to the insert portion 90 and the block 60. The attachment feature 108 may extend from the deck face 70 though the bulkhead 74 and to the insert 80. The attachment feature 108 also extends upwardly though a corresponding cylinder head 62. All of the bore may be tapped or only a portion of the bore may be tapped. Tapped regions of the bore may be located in both portion 90 and the block 60, or only in one portion 90. Therefore, the head bearing bolts connect only to the insert 80 and any loads are transferred directly through the insert. Loads on the remainder of the block 60 may therefore be indirect.

A force is imparted on the engine due to a combustion event in the combustion chamber 24 of the engine 20. Due to the combustion event, the head bolts 108 experience a reactive force, shown by arrows 132, opposing the combustion force, as the fasteners 108 are connecting the cylinder head to the cylinder block. Due to the combustion event, reactive forces 132 load the fasteners which are threaded into the end region 92 of the insert portion 90 of the insert 80. The force travels through the first and second straps 94, 96 of the insert portion 90 where the combustion force reacts on the cap portion 82 of the main bearing. The combustion force or load is imparted onto the main bearing shell and main bearing cap portion 82, and is generally shown by arrow 134. Main bearing bolts 86 or main bearing cap fasteners apply a clamp load by threading into bulkhead insert along the main bearing column and oppose the force 134.

Figure 4:
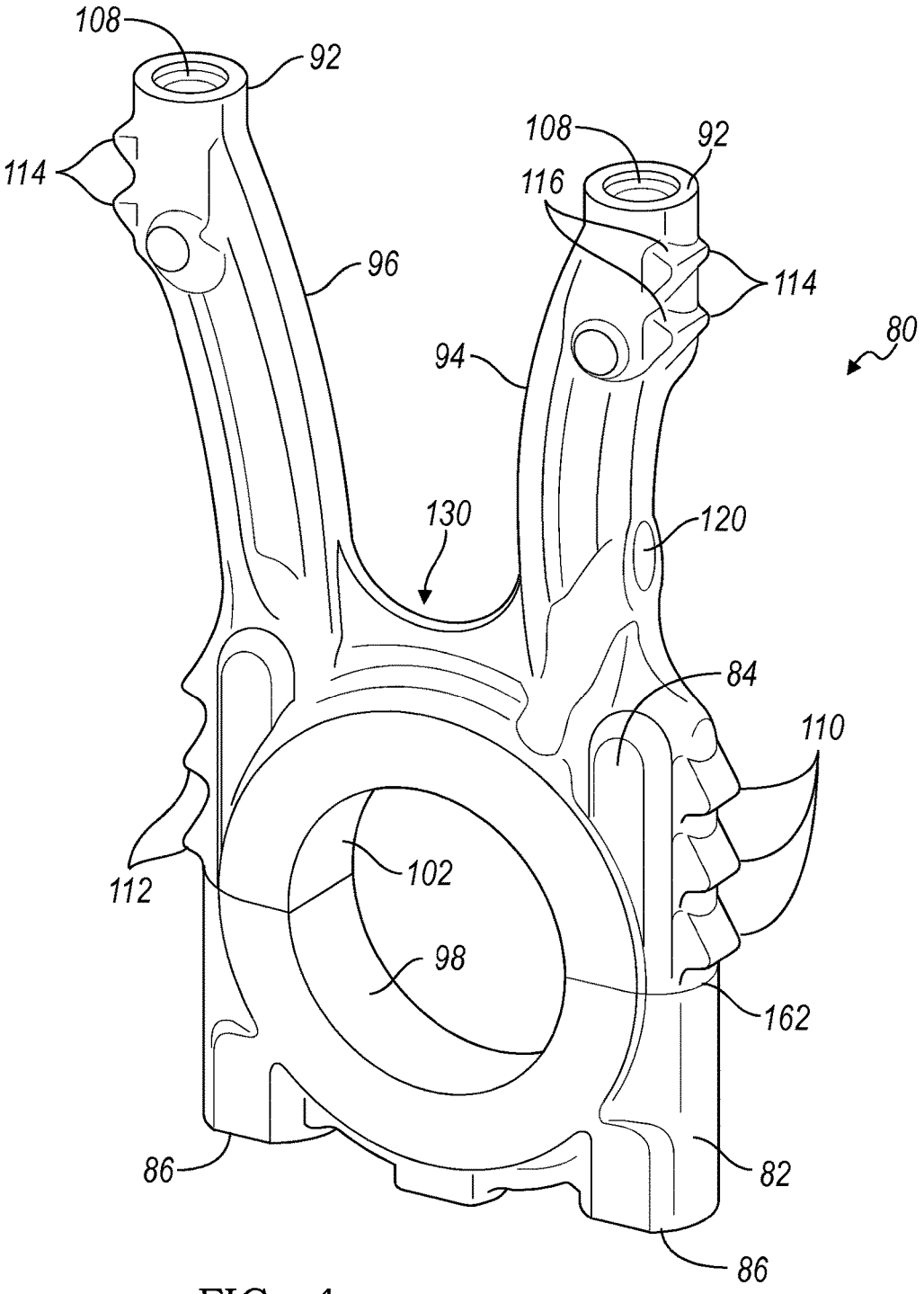
FIG. 4 illustrates a perspective view of an insert for use with the engine of FIG. 2.

FIG. 4 illustrates a perspective view of the insert 80. As can be seen from FIGS. 3-4, the insert 80 has a series of surface features 110 on the first end region 84. The surface features 110 may be a series of protrusions, teeth, or serrations. Each protrusion 110 has a surface 112 that is inclined to and/or is substantially normal to engine combustion and reactive loads. The orientation of these surfaces 112 assists in the transfer of loads to the insert 80.

The insert 80 also has a series of surface features 114 on the second end region 84. The surface features 114 may be a series of protrusions, teeth, or serrations. Each protrusion 114 has a surface 116 that is inclined to and/or is substantially normal to engine combustion and reactive loads. The orientation of these surfaces 116 assists in the transfer of loads to the insert 80.

As can be seen from FIG. 4, the surface features 110, 114 may have depth to them such that they extend along the longitudinal axis 122 of the engine 20. The longitudinal axis 122 is illustrated in FIG. 3, and extends through the centers of adjacent cylinders in engine 20 according to the present example. The transverse axis 124 and vertical axis 126 are also illustrated. The vertical axis may or may not be aligned with a gravitational force on the engine 20.

The faces or normal surfaces 112, 116 may be generally or substantially parallel with one another. In other examples, the faces 112, 116 may be angled or inclined relative to one another.

In further examples, the surface features 110, 114 may be positioned in other locations on the insert 80. The surface features 110, 114 may also be provided in other shapes and dimensions. The surface features 110, 114 may be other macro-tribology surface features, and may include various specified roughnesses. Alternatively, the insert 80 may have serrations 110, 114 as well as additional macro-tribology surface features to stabilize against engine combustion and reactive loads during engine operation and use.

In further examples, only one set of surface features 110, 114 may be provided, or more than two sets may be provided. The surface features are illustrated as being similar to one another on either side of the first end region and on either side of the second end region; however, the surface features may vary in size, shape, and number in various locations on the insert 80.

The insert 80 may be provided with a drilled or otherwise formed passage for engine fluids. For example, passage 120 is formed in the insert 80 to provide flow of a lubricant to the main bearing 100.

Figure 5:
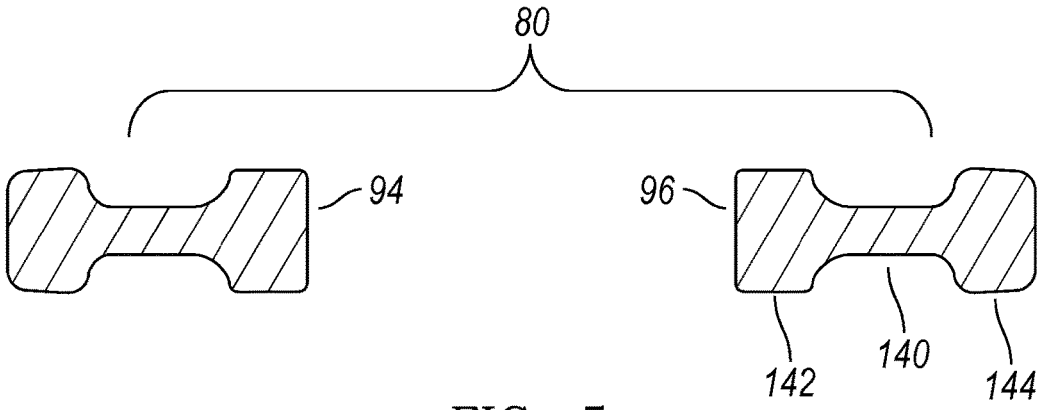
FIG. 5 illustrates a sectional view of the insert of FIG. 4.

Referring generally to FIGS. 3-5, the straps 94, 96 extend outwardly from the first end region 84 and generally away from one another. The straps 94, 96 may form a symmetrical or asymmetrical V-shape for example. A portion of the second end region 92 is provided at an end of each strap 94, 96 and includes the cylinder head bolt columns 108.

The straps 94, 96 are illustrated as being asymmetrical, and this configuration may be used for an engine 20 having an offset crankshaft. An offset crankshaft is a crankshaft 36 that is offset from the centerline of the cylinders, or offset from axis 122. For an offset crankshaft, each straps 94, 96 may have a different length, different shape or arch, and different cross-sectional area or shape. The straps 94, 96 need to generally carry the same load between the end region 84 and a respective head bolt column 108, and the straps 94, 96 are dimensioned to carry substantially equal loads. For example, with an offset crankshaft 36, one strap may need to be dimensioned differently than the other strap based on the load path being angled. The straps 94, 96 may also need to have varying dimensions from one another due to torsional forces during engine operation, such as those caused by twist in the crankshaft 36.

The insert 80 may be provided with a continuous arch 130 extending between the two straps 94, 96. This continuous arch 130 is adjacent to the first end region 84 of the insert 80. The continuous arch 130 is provided to reduce or eliminate steps, corners, or other discontinuities that may cause a stress point in the insert 80 leading to fatigue, cracking, and other issues under repeated load and engine use. The arch 130 structure provides for a smooth load distribution and load path through the insert 80.

FIG. 5 illustrates a cross sectional view of the insert 80 taken in a plane parallel to axes 122, 124, and illustrates the cross-section of the straps 94, 96. As shown in FIG. 5, the cross-sectional area of one strap is substantially equal to a cross-sectional area of the other strap. In other examples, the cross-sectional areas of each strap 94, 96 may be different from one another.

The straps 94, 96 are illustrated as having a flanged, beam-shaped cross-section, and in the example shown, have an I-beam cross-section. Although an I-beam is a preferred cross-section, other beam sections may be used and include a C-shaped beam shape, an L-shaped beam shape, a T-shaped beam shape, and the like. The flanged beam cross-section is used for the straps 94, 96 to increase the strength of each member. Without this shape, the straps 94, 96 may have insufficient strength as the cross-sectional area is limited by the packaging constraints of the engine and the narrow bulkhead region 74.

The I-beam shapes of each strap 94, 96 have a center section 140 with a first end flange 142 and a second end flange 144. The center section 140 connects to an intermediate region of each of the end flanges 142, 144. The I-beams are illustrated as being generally symmetrical; however the I-beams may be asymmetrical with one or more of the sections 140, 142, 144 connected at an offset relative to the other.

The beam shape for each strap 94, 96 may be same or may vary from one another. For example, the center sections 140 may have the same or different lengths or widths, the end flanges may have the same or different lengths and widths, and/or the center sections 140 may connect to each end flange 142, 144 at the same or different points.

Figure 6:
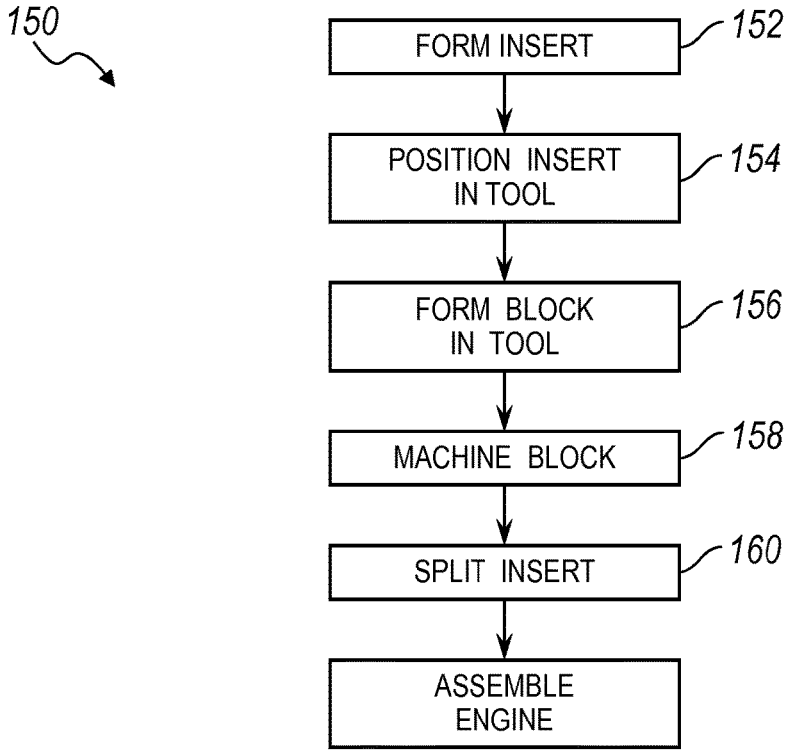
FIG. 6 illustrates a flow chart of a method for forming an engine with an insert according to an embodiment.

FIG. 6 illustrates a process or a method 150 for forming and/or assembling an engine, such as engine 20 according to an embodiment. Various embodiments of the method 150 may include greater or fewer steps, and the steps may be performed in another order than illustrated.

An insert 80 is formed at step 152. In the example shown, the insert 80 is cast and comprises iron, a ferrous alloy, and the like. In other examples, the insert 80 is formed from another suitable material with a greater strength than the block 60 material. The insert 80 may be cast using a near net shape casting process, and may be cast using a high pressure or low pressure process. The insert is formed with the surface features and tribology features as described above, and in further examples, additional surface features may be provided by a machining process or the like. The insert 80 is also formed with various touch points and locators appropriate for the method of engine block 60 manufacture as described below. In other examples, the insert 80 may be formed using other appropriate manufacturing techniques, including, but not limited to, casting, powder metallurgy techniques, forging, machining, die casting and heat treating, etc.

The insert 80 is positioned within a tool for forming the engine block 60 at step 154. The tool is provided according to the manufacturing technique for the engine block 60, and may include various dies, molds, slides, and the like. The tool may also include various inserts or cores to provide other features of the block 60. The insert may be coated before being placed in the tool to provide an improved bond with the block 60. The insert may also be machined or cubed, etc. before placement in the tool.

The engine block 60 is formed at step 156. The engine block 60 is formed according to the manufacturing technique appropriate for the primary material of the block 60. In one example, the engine block 60 is cast as an aluminum or aluminum alloy around the insert(s) 80 as a casting process. The engine block 60 may be cast using a high pressure casting process or a low pressure casting process, and may be a sand casting, a die casting, and the like. In another example, the engine block is molded or injection molded as a composite material around metal insert(s) 80.

As can be seen from the description, the insert 80 is typically formed of a different material than the block 60. The insert 80 may be formed from a higher strength material, while the block 60 may be formed from a material with reduced weight, higher thermal conductivity, and the like. The structure of the insert 80 may additionally allow for a lower strength material, lighter block 60 to be provided than would otherwise be available in an engine without insert(s) 80 in the bulkhead(s).

The block 60 is removed from the tool and may be machined or otherwise post-processed at step 158 to form various features of the block 60. For example, the block 60 may be machined to form the deck face 70, etc. Additionally, the block 60 may be machined, or drilled and tapped, to form the head bolt bores into the block and insert. The insert 80 may be machined, or drilled and tapped, to form the main bearing cap bores. The block and insert may be machined to form various cooling or lubrication passages in the engine 20, such as passage 120.

The insert 80 is split or divided at step 160 to form the insert portion 90 and the cap portion 82. In one example, the insert 80 is fracture split, which may include forming a fracture line or locator using a process such as laser etching or scoring. The insert 80 is cranked or split after the fracture split line is defined. After the split, the insert 80 has a cap portion 82 and an insert portion 90 with mating surfaces formed by the split that mate along the split line 162 as shown in FIGS. 3 and 4. The split line 162 may be linear, non-linear, symmetric, asymmetric, or otherwise shaped.

By splitting the insert 80 after the block 60 has been formed and by forming the block material generally up to where the fracture line 162 is going to be placed, several advantages are realized, which include removing a saddle and lock width machining process that is typically present with a fracture split design, and eliminating bi-material machining which causes shortened tool life, and has the potential for increased scrap rates.

As the insert portion 90 and the cap portion 82 are formed from the same material, the engine 20 may operate with reduced noise, vibration, and harshness as the two components have a common coefficient of thermal expansion.

Although the surface features and macro-tribology features are positioned on the insert 80 to interact with combustion and reaction loads during engine operation, they may also have a secondary benefit of stabilizing the insert 80 within the block 60, and maintaining the bond between the insert portion 90 and the block 60 while the insert 80 is being split and machined.

After the insert 80 is split, additional machining may be conducted, for example, to machine the bore for the crankshaft bearing, e.g. to machine surfaces 98, 102.

In addition to a straightforward split of the insert 80 as shown, it is also envisioned that the split may include the addition of a groove on the cap portion 82 and a mating protrusion on the insert portion 90, or vice versa. The groove and protrusion would mate when the insert 80 is reassembled to assist in locating the cap portion 82 when the main bearing fasteners are inserted, and may also assist the main bearings in any torsional or side loads on the cap portion 82.

The engine 20 is assembled at step 162, and may include placing the engine 20 into a vehicle. The cylinder head 62 is connected to the block 60 using head bolts connected to the insert 80 at attachment points 108. The main bearings and crankshaft 36 are positioned within surface 102, and the cap portion 98 is then located. The main bearing bolts are used to connect the cap portion 82 to the insert portion 90 via attachment points 86. The insert 80 is therefore mechanically connected or fastened to both the head bolts and main bearing bolts to provide a load path therebetween.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments of the invention.

What is claimed is:

1. An engine comprising:

a cylinder block defining at least one main bearing bulkhead adjacent to a cylinder;

a crankshaft rotatably housed within the block by a main bearing; and a bulkhead insert having an insert portion and a cap portion, the insert portion provided within the bulkhead and having first and second end regions connected by first and second straps, each strap having a flanged beam cross section, the first and second ends of the insert portion configured to connect a main bearing cap column to a cylinder head column, each of the first and second end regions defining at least one protrusion having a surface, the surface being at least one of inclined relative to and normal to engine combustion and reactive loads, the cap portion configured to mate with the first end region at the main bearing cap column and support the main bearing.

2. The engine of claim 1 wherein the at least one protrusion of the first end region is a first series of serrations, wherein each serration of the first series of serrations defines a face that provides a portion of the surface of the first end region and is normal to an engine reactive load; and wherein the at least one protrusion of the second end region is a second series of serrations, wherein each serration of the second series of serrations defines a face that provides a portion of the surface of the second end region and is normal to an engine combustion load.

3. The engine of claim 1 further comprising a cylinder head configured to mate with the cylinder block; and a head bolt for connecting the head to the block via the cylinder head column, a portion of the head bolt being received by the second end region of the insert portion of the bulkhead insert.

4. The engine of claim 1 wherein the cylinder block is formed from a first material and the bulkhead insert is formed from a second material.

5. The engine of claim 4 wherein the first material comprises aluminum and the second material comprises iron.

6. The engine of claim 1 wherein the crankshaft is offset from a centerline of a cylinder; and wherein a cross sectional area of the first strap is greater than a cross sectional area of the second strap.

7. An engine main bearing structure comprising:

a bulkhead insert for connecting a main bearing cap column to a head column and having first and second ends connected by a pair of straps, each strap having an I-beam cross-section, each end defining at least one protrusion having a surface normal to engine combustion and reactive loads, the first end shaped to support a crankshaft main bearing, the second end configured to receive head bolts.

8. The bearing structure of claim 7 further comprising a main bearing cap configured to mate with the first end of the insert and shaped to support the main bearing.

9. The bearing structure of claim 7 wherein the straps extend outwardly from the first end and from one another, each strap defining a portion of the second end of the insert and providing a portion of a head bolt column.

10. The bearing structure of claim 7 further comprising a continuous arch adjacent to the first end of the insert, the continuous arch extending between the pair of straps.

11. The bearing structure of claim 7 wherein the at least one protrusion of the first end is a first series of serrations, wherein each serration of the first series of serrations defines a face that provides a portion of the surface of the first end and is normal to an engine reactive load.

12. The bearing structure of claim 11 wherein the at least one protrusion of the second end is a second series of serrations, wherein each serration of the second series of serrations defines a face that provides a portion of the surface of the second end and is normal to an engine combustion load.

13. The bearing structure of claim 12 wherein the faces of the first series of serrations are parallel with the faces of the second series of serrations.

14. The bearing structure of claim 7 wherein each of the pair of straps has a respective cross-sectional area taken in a plane parallel with a mating surface of the first end of the insert, wherein the cross-sectional area of one of the pair of straps is greater than the cross-sectional area of the other of the pair of straps.

15. The bearing structure of claim 7 wherein the insert further comprises at least one region of macro-tribology features to stabilize against engine combustion and reactive loads.

16. The bearing structure of claim 7 wherein the insert further comprises a coating configured to bond with a cylinder block of the engine surrounding the insert.

17. A method of forming an engine comprising:

providing a bulkhead insert in a tool, the bulkhead insert configured to connect a main bearing cap column to a cylinder head column, the bulkhead insert having first and second straps, each strap having a flanged beam cross section, the insert defining protrusions having surfaces normal to engine combustion and reactive loads; and forming an engine block having a bulkhead containing the bulkhead insert in the tool.

18. The method of claim 17 further comprising fracturing the bulkhead insert into an insert portion and a cap portion, the insert portion provided within the bulkhead, the cap portion configured to cooperate with the insert portion to support a main bearing of a crankshaft.

19. The method of claim 18 further comprising:

facing the engine block to form a deck face configured to mate with a cylinder head;

forming a cylinder head column into the bulkhead insert for receiving a cylinder head bolt; and forming a main bearing column through the cap portion and into the insert portion for receiving a main bearing cap fastener.

20. The method of claim 17 further comprising forming the insert with first and second straps each having I-beam cross sections, and with protrusions having surfaces normal to engine combustion and reactive loads.

* * * * *